United States Patent [19]

Nishida et al.

[11] 3,990,583

[45] Nov. 9, 1976

[54] DEVICE FOR CONTROLLING THE BOOM ELEVATION OF A SIDE CRANE

[75] Inventors: Kazumori Nishida; Toshinori Kawahashi, both of Hirakata, Japan

[73] Assignee: Kabushiki Kaisha Komatsu Seisakusho, Tokyo, Japan

[22] Filed: Mar. 14, 1974

[21] Appl. No.: 451,158

[30] Foreign Application Priority Data

Aug. 23, 1973 Japan ..... 48-93856

[52] U.S. Cl. ..... 212/8 B; 91/420; 91/441; 91/448; 91/465; 137/596.12

[51] Int. Cl.[2] ..... B66C 23/56; F15B 13/042; F15B 13/06

[58] Field of Search ..... 212/8 B; 91/420, 441, 91/34, 444, 448, 450, 455, 464, 465, 462; 137/596, 596.12

[56] References Cited

UNITED STATES PATENTS

| | | | |
|---|---|---|---|
| 3,241,461 | 3/1966 | Drone | 137/596.12 X |
| 3,265,218 | 8/1966 | Stefanutti | 212/8 A |
| 3,381,587 | 5/1968 | Parquet | 91/448 X |
| 3,430,540 | 3/1969 | Linz | 91/420 |
| 3,566,903 | 3/1971 | Honeycutt | 91/464 X |
| 3,595,264 | 7/1971 | Martin | 91/420 X |

*Primary Examiner*—Irwin C. Cohen
*Attorney, Agent, or Firm*—Oblon, Fisher, Spivak, McClelland & Maier

[57] ABSTRACT

A device for elevating the boom of a side crane has a double acting valve provided in a hydraulic circuit so as to permit natural lowering of the boom of the side crane under its own weight as well as forcible raising and lowering hydraulically, and also so as to maintain the boom without need of further fluid supply from a pump in its forcibly lowered or lifted state for a long period of time through the trapping of hydraulic fluid within the boom cylinders on both the lifting and lowering sides thereof.

1 Claim, 4 Drawing Figures

DEVICE FOR CONTROLLING THE BOOM ELEVATION OF A SIDE CRANE

BACKGROUND OF THE INVENTION

1. Field of the Invention

This invention relates generally to a side crane, and more particularly to a device for elevating the boom of a side crane which is adapted for naturally lowering and hydraulically forcibly lifting or lowering the boom so as to maintain the boom without the necessity of continued oil supply from a pump in a forcibly lowering or lifting state for a long time.

2. Description of the Prior Art

In conventional side cranes, there are generally two types of devices for lifting and lowering the booms thereof, namely the cable type and the hydraulic type, and the lowering of a side crane of the cable type is obtained under the force of its own weight, and that of the hydraulic type is obtained generally in the same manner as that of cable types, but they do not provide for such lowering forcibly. Therefore, the conventional side crane cannot serve in a pushing operation by utilizing the boom, nor can the vehicle body be prevented from falling down by forcible operation of the boom.

SUMMARY OF THE INVENTION

It is, therefore, an object of the present invention to provide a device for lifting or lowering a boom of a side crane which may forcibly lift or lower the boom in addition to permitting the natural lowering thereof under its own weight.

It is another object of the present invention to provide a device for lifting or lowering a boom of a side crane which may maintain pushing and drawing forces with a boom cylinder for a long period of time.

It is a further object of the present invention to provide a device for lifting or lowering a boom of a side crane which may conduct pushing operations by utilizing the boom.

It is still another object of the present invention to provide a device for lifting or lowering a boom of a side crane wherein the boom may be utilized to prevent the vehicle body from falling down.

The foregoing and other objects are achieved according to the present invention through the provision of a lifting or lowering control valve connected on its inlet side to a drain tank and a hydraulic pump and on its outlet side to separate conduit means leading respectively to the boom lifting and lowering sides of a boom cylinder mounted on the side crane body. Pilot check valves which normally allow flow of the hydraulic fluid in the direction of the boom cylinder are disposed in each of the separate conduits. A double-acting valve also is disposed in the conduit means connecting the control valve and the boom lowering side of the boom cylinder, being located between the pilot check valve therein and the control valve, and being operative to either permit flow therethrough from the control valve and hydraulic pump to the boom cylinder or to permit flow from the boom cylinder to the drain tank. A by-pass conduit between the conduit means connecting the control valve and the lifting side of the boom cylinder and the pilot check valve in the conduit means connecting the control valve and the lowering side of the boom cylinder and a second by-pass conduit between the conduit means connecting the control valve and the lowering side of the boom cylinder and the pilot check valve in the conduit means connecting the control valve and the lifting side of the boom cylinder permit relief of the pilot check valves so as to allow flow of hydraulic fluid therethrough in the direction away from the boom cylinder. Thus, it is possible to have natural lowering of the boom under its own weight and forcible lifting and lowering under hydraulic pressure, as desired, and to trap hydraulic fluid within both the lifting and lowering sides of the boom cylinder whereby the boom may be maintained at a forcibly lowered or lifted position for a long time without additional application of fluid for performing pushing or drawing operations.

These and other objects, features and attendant advantages of the present invention for lifting or lowering the boom of a side crane will be more fully appreciated as the same becomes better understood from the following detailed description when taken in conjunction with the accompanying drawings, in which like reference numerals and characters designate corresponding parts and components throughout the several figures and in which.

DETAILED DESCRIPTION OF A PREFERRED EMBODIMENT

Figure 1:
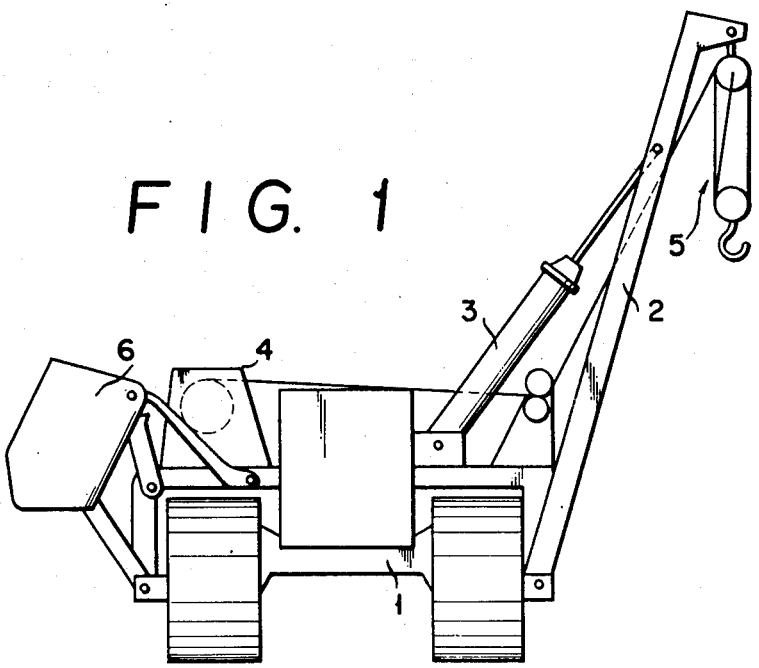
FIG. 1 is a schematic front view of a side crane to which the present invention is applied.

Referring now to the drawings, and more particularly to FIG. 1 thereof, a body 1 of a side crane is shown supporting a boom 2 of the side crane, the boom 2 being pivotally engaged at its one end of the side crane body 1, and a boom cylinder 3 for lifting or lowering the boom 2, the cylinder 3 being pivotally engaged at its one end on the side crane body 1 and having an extensible rod movable therein from its other end being pivotally connected at its remote end to the boom 2 at a point spaced a preselected distance from the side crane body 1. A winch 4 is disposed on the side crane body 1 for winding up or feeding the wire of a suspension device 5 pivotally carried from the boom 2 at the remote end thereof, and a counterweight 6 is disposed on the side of the side crane body 1 opposite the boom 2.

Figure 2:
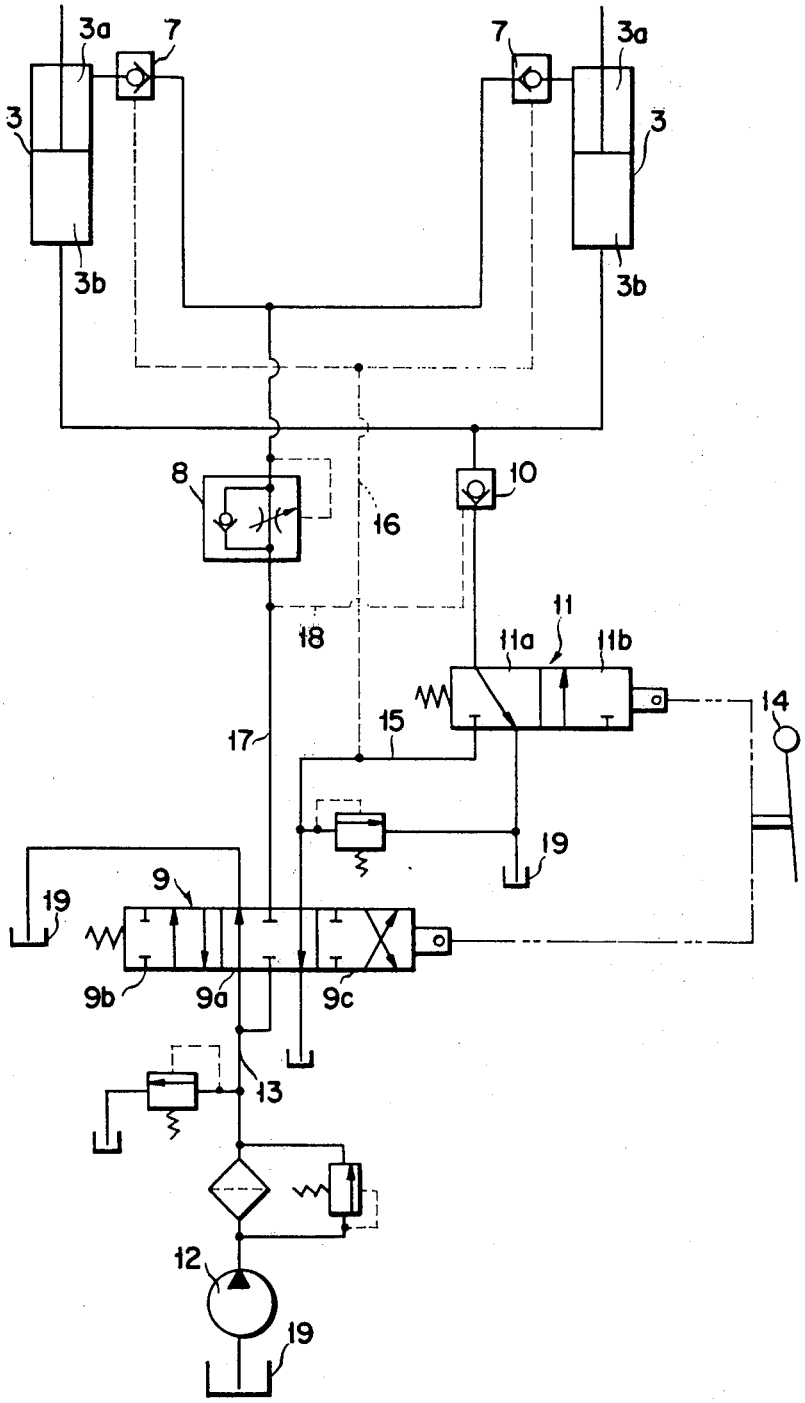
FIG. 2 is a hydraulic circuit of the device for lifting or lowering the boom of a side crane according to the present invention.

In FIG. 2 there is shown a hydraulic circuit for controlling the boom cylinder 3 of the device of the present invention. This device for lifting or lowering the boom 2 has two boom cylinders 3, which are operative simultaneously in a manner such that when hydraulic fluid is supplied to the head sides **3*a* of the boom cylinder 3, the boom 2 is lifted or raised upwardly, while when hydraulic fluid is supplied to the bottom sides 3*b* of the boom cylinders 3, the boom 2 is forcibly lowered. The head sides or lifting sides 3*a* of the boom cylinders 3 are connected respectively through pilot check valves 7 and a common down control valve 8 to the outlet side of a boom lifting or lowering control valve 9, and the bottom sides or lowering sides 3*b* of the boom cylinders 3 are connected to a common pilot check valve 10 and therethrough to a double acting valve 11 to the outlet side of the boom lifting or lowering control valve 9. The pilot check valves 7 and 10 are of a type so as to normally allow flow of hydraulic oil only in the direction of the cylinder 3**. The manner in which relief of this condition is achieved will be described hereinafter.

The boom control valve 9 has neutral, lifting and lowering positions 9*a*, 9*b* and 9*c*, respectively, and also has first and second ports connected to a pump 12 and a third port connected to a tank 19 at the inlet side thereof, and a fourth port connected also to the tank 19, a fifth port connected through a conduit 17 to the down control valve 8 and a sixth port connected through a conduit 15 to the double-acting valve 11 at the outlet side thereof, all as shown in FIG. 2.

The double-acting valve 11 has shut-off and communication positions 11*a* and 11*b*, respectively, and also has a first port connected to the boom lifting or lowering control valve 9, through the conduit 15, a second port connected to the tank 19, and a third port connected to the pilot check valve 10. Both the boom lifting or lowering control valve 9 and the double-acting valve 11 are interlocked to one lever 14 so as to be operated thereby. The double-acting valve 11 is normally positioned in its shut-off position 11*a*, as shown, and is transferred to its communication position 11*b* when the boom lifting or lowering control valve 9 is transferred to the boom lowering position 9*c* and the lever 14 is further operated toward its lowering side.

On the other hand, the pilot check valves 7, connected in the boom lifting side as heretofore described, are connected to the conduit 15 between the double-acting valve 11 and the boom lifting or lowering control valve 9 through a conduit 16 designated by a broken line in FIG. 2, and the pilot check valve 10, connected in the boom lowering side as heretofore described, is connected to the conduit 17 between the down control valve 8 and the boom lifting or lowering control valve 9 through a conduit 18 similarly designated by a broken line in FIG. 2.

When the double-acting valve 11 is disposed in its shut-off position 11*a*, as shown in FIG. 2, the boom lowering sides 3*b* of the cylinders 3 are connected therethrough to the tank 19 to be drained, via the check valve 10, which in the position of control valve 9 shown in FIG. 2 will prevent such drainage.

However, in the operation of the device thus constructed, when the boom lifting or lowering control valve 9 is transferred from its neutral position 9*a* to the boom lifting position 9*b*, by the operation of lever 14 manually, hydraulic oil from the pump 12 is fed through the conduit 13, the boom lifting or lowering control valve 9, conduit 17, the down control valve 8, and the pilot check valves 7 to the boom lifting sides 3*a* of the boom cylinders 3, and also from the conduit 17, through the conduit 18, to the pilot check valve 10 to open the pilot check valve 10 for thereby permitting feeding of the hydraulic oil in the boom lowering sides 3*b* of the boom cylinders 3 through the normally one-way operative pilot check valve 10 and the double-acting valve 11 to the tank 19 to be drained, so as to permit lifting or raising of the boom by the boom cylinders 3.

On the other hand, when the boom lifting or lowering control valve 9 is transferred from its neutral position 9*a* to the boom lowering position 9*c*, again by the operation of lever 14 manually, hydraulic oil from the pump 12 is fed through the conduit 13, the boom lifting or lowering control valve 9, the conduit 15, and conduit 16 to the pilot check valves 7, thus to open the normally one-way operative pilot check valves 7 and thereby permit draining of the hydraulic oil in the boom lifting sides 3*a* of the boom cylinders 3 through the pilot check valves 7, the down control valve 8, and the boom lifting or lowering control valve 9 to the tank 19, so as to naturally lower the boom 2 under its own weight. Since the boom lowering sides 3*b* of the boom cylinders 3 become negative or vacuum, hydraulic oil is naturally supplied thereto from the tank 19.

Then, when the operation lever 14 is further operated to be transferred to the boom lowering side of its movement, the double-acting valve 11 is transferred to its communication position 11*b*, wherein hydraulic oil from the pump 12 being fed through the conduit 15 passes through the double-acting valve 11 to the pilot check valve 10, and therethrough to the boom lowering sides 3*b* of the boom cylinders 3, so as to forcibly lower the boom 2.

Figure 4:
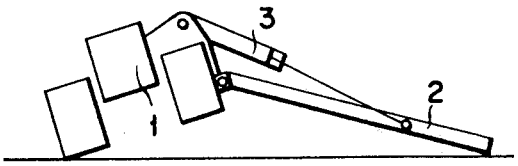
FIG. 4 is a schematic view of one example of the boom in the operating state of the device of the present invention.

When the operation lever 14 is then returned to its initial position, the boom lifting or lowering control valve 9 and the double-acting valve 11 are instantaneously returned to their respective neutral positions, 9*a* and 11*a*, as shown in FIG. 2, and thereby the pilot pressure to the pilot check valves 7 and 10 connected in the boom lifting and lowering sides of the hydraulic circuit is drained so as to close the pilot check valves 7 and 10. Accordingly, the cylinders 3 remain filled with hydraulic fluid in both the boom lowering and lifting sides 3*b* and 3*a* so that the cylinders 3 are left in the actuated state, and thereby maintained, for example as shown in FIG. 4, where the boom 2 is lowered so that a load is being applied to the boom.

Figure 3:
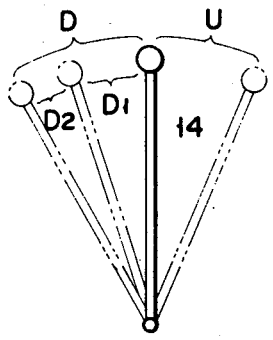
FIG. 3 is a view of the operating state of the operation lever used in the device of the present invention.

The operating states of the operation lever 14 are shown in FIG. 3 in such a manner that when the lever 14 is moved through a given direction by an amount U, the boom is lifted or raised upwardly, while when the lever 14 is moved from its neutral position in the other direction by an amount D, such as, for example, by D1, the boom lifting or lowering control valve 9 is transferred to the boom lowering position to act in a single acting range, or to be lowered under its own weight, and by D2, the double-acting valve 11 is also transferred to its communication position 11*b* to act in a double-acting range, or to lower the boom forcibly.

It should be understood from the foregoing description that since the device for lifting or lowering the boom of a side crane of the present invention having two boom cylinders 3 including boom lifting and lowering sides 3*a* and 3*b*, a boom lifting or lowering control valve 9, a pump 12, and a tank 19 features the double-acting valve 11 connected in the circuit so as to be connected to the boom lowering sides 3*b* of the boom cylinders 3 for connecting the boom lowering sides 3*b* thereof to the drainage tank 19 or to the pump 12 through the boom lowering side 9*c* of the boom lifting or lowering control valve 9, and since pilot check valves 7 and 10 connected in the vicinity of the inlet and outlet of the hydraulic circuits for providing hydraulic fluid communication with the boom lifting and lowering sides 3*a* and 3*b* of the boom cylinders 3 normally permit flow only in the direction leading into the inlets thereof, but may be relieved by the pilot circuit 16 in the case of the pilot check valves 7 for allowing fluid flow out of the boom lifting sides 3*a* of the boom cylinders 3 through the check valves 7 and by the pilot circuit 18 in the case of the pilot check valve 10 for allowing fluid flow out of the boom lowering sides 3*b* of the boom cylinders 3 through the check valve 10, the side crane may forcibly lift or lower the boom under hydraulic pressure or may naturally lower the boom under its own weight, and may maintain the pushing and drawing forces of a boom cylinder for a long time by returning the operation lever 14 to its neutral position to close the circuits with hydraulic fluid being trapped in the boom cylinders 3. Therefore, the device of the present invention may conduct a pushing operation by utilizing the boom 2, such as for hammering a pole by forcibly lowering the boom 2, and may prevent the vehicle body from falling down by pushing with the boom, and further may maintain the boom 2 in the state for lifting or lowering on the way and for applying a load to the boom 2 and for shutting off the hydraulic fluid oil being supplied from the pump 12 for a long time. Since the boom 2 is forcibly lifted or lowered, the temperature increase of the hydraulic oil is also prevented by relieving the control valve.

Obviously, many modifications and variations of the present invention are posssible in light of these teachings. It is therefore to be understood that within the scope of the appended claims the invention may be practiced otherwise than as specifically described herein.

What is claimed as new and desired to be secured by Letters Patent of the United States is:

1. A device for lifting or lowering the boom of a side crane comprising:

a side crane body;

a boom pivotably mounted upon the body of said side crane;

at least one boom cylinder for lifting or lowering said boom;

a drain tank;

a hydraulic pump for supplying hydraulic fluid from said drain tank to said at least one boom cylinder;

a boom lifting or lowering control valve connected at its inlet side to said drain tank and said hydraulic pump and at its outlet side through a first conduit means to a boom lifting side of said at least one boom cylinder and through a second conduit means to a boom lowering side of said at least one boom cylinder, and including three alternatively selectable positions comprising a neutral position in which said first conduit means is disconnected from said hydraulic pump and said drain tank while said second conduit means is connected to said drain tank, a boom lifting position in which said first conduit means and said second conduit means are respectively connected to said hydraulic pump and said drain tank, and a boom lowering position in which said first conduit means and said second conduit means are respectively connected to said drain tank and said hydraulic pump;

a sole double-acting valve disposed only in said second conduit means and interposed between said boom lifting or lowering control valve and said boom lowering side of said at least one boom cylinder, said double-acting valve being connected at its inlet side to said drain tank and said boom lifting or lowering control valve and having two alternatively selectable positions comprising a first position in which said boom lowering side of said at least one boom cylinder is disconnected from said hydraulic pump and connected to said drain tank and a second position in which said boom lowering side of said at least one boom cylinder is connected to said hydraulic pump and disconnected from said drain tank;

pilot check valve means, provided in said first conduit means between said control valve and said boom lifting side of said at least one boom cylinder, for normally permitting flow of hydraulic fluid only in the direction toward said boom lifting side of said at least one boom cylinder;

another pilot check valve means, provided in said second conduit means between said double-acting valve and said boom lowering side of said at least one boom cylinder, for normally permitting flow of hydraulic fluid only in the direction toward said boom lowering side of said at least one boom cylinder;

third conduit means connecting said first conduit means and said another pilot check valve means for opening said another pilot check valve means to permit flow of hydraulic fluid therethrough from said boom lowering side of said at least one boom cylinder to said drain tank when said boom lifting or lowering control valve is disposed in said boom lifting position;

fourth conduit means connecting said second conduit means and said pilot check valve means for opening said pilot check valve means to permit flow of hydraulic fluid therethrough from said boom lifting side of said at least one boom cylinder to said drain tank when said boom lifting or lowering control valve is disposed in said boom lowering position; and movable lever means mechanically connected to both said boom lifting or lowering control valve and said double-acting valve for actuating same, simultaneously with, or independent of, each other, (a) to said boom lowering position and said first position, respectively, so as to naturally lower said boom under the influence of its own weight, (b) to said boom lowering position and said second position, respectively, so as to forcibly lower said boom under the influence of hydraulic fluid, (c) to said boom lifting position and said first position, respectively, so as to lift said boom under the influence of hydraulic fluid, and (d) to said neutral position and said first position, respectively, so as to maintain said boom in an optional actuated state by closing said pilot check valve means and said another pilot check valve means thereby trapping hydraulic fluid within said at least one boom cylinder.

* * * * *